US007793723B2

(12) United States Patent
Vedeld et al.

(10) Patent No.: US 7,793,723 B2
(45) Date of Patent: Sep. 14, 2010

(54) SUBMERGED LOADING SYSTEM

(75) Inventors: Stein Vedeld, La Turbie (FR); Pierre Balleraud, Nice (FR); Hein Wille, Eze (FR)

(73) Assignee: Single Buoy Moorings, Inc. (CH)

( * ) Notice: Subject to any disclaimer, the term of this patent is extended or adjusted under 35 U.S.C. 154(b) by 89 days.

(21) Appl. No.: 11/651,794

(22) Filed: Jan. 10, 2007

(65) Prior Publication Data

US 2007/0163481 A1 Jul. 19, 2007

Related U.S. Application Data

(60) Provisional application No. 60/760,069, filed on Jan. 19, 2006.

(51) Int. Cl.

| | |
|---|---|
| ***E21B 17/01*** | (2006.01) |
| ***E21B 7/12*** | (2006.01) |
| ***E02S 15/05*** | (2006.01) |
| ***B63B 22/02*** | (2006.01) |

(52) U.S. Cl. ..... 166/355; 166/352; 166/354; 166/367; 441/4; 114/230.13; 405/224.3

(58) Field of Classification Search ..... 166/367, 166/353, 355, 352; 405/169, 170, 224.2–224; 441/4

See application file for complete search history.

(56) References Cited

U.S. PATENT DOCUMENTS

| | | | | | |
|---|---|---|---|---|---|
| 2,771,617 | A | * | 11/1956 | Brackx | 441/4 |
| 2,882,536 | A | * | 4/1959 | Jordan | 441/4 |
| 3,236,266 | A | * | 2/1966 | Bily | 141/1 |
| 3,363,683 | A | * | 1/1968 | Corley, Jr. et al. | 166/355 |
| 3,372,409 | A | * | 3/1968 | Manning | 114/230.13 |
| 3,440,671 | A | * | 4/1969 | Smulders | 441/5 |
| 3,472,293 | A | * | 10/1969 | Bily | 141/387 |
| 3,515,182 | A | | 6/1970 | Dickson et al. | |
| 3,556,170 | A | * | 1/1971 | Bily | 141/1 |
| 3,602,175 | A | * | 8/1971 | Morgan et al. | 114/293 |
| 3,614,869 | A | * | 10/1971 | Flory et al. | 405/224.2 |
| 3,700,014 | A | * | 10/1972 | Scales et al. | 141/388 |
| 3,782,458 | A | * | 1/1974 | Slack | 166/355 |

(Continued)

FOREIGN PATENT DOCUMENTS

EP 0729882 A1 9/1996

(Continued)

*Primary Examiner*—Thomas A Beach
(74) *Attorney, Agent, or Firm*—Leon D. Rosen

(57) ABSTRACT

An offshore system allows a vessel (12) to sail to a predetermined sea location (14), quickly set up a loading system and start the transfer of hydrocarbons to or from a pipeline (22), and then quickly disconnect and sail away. The vessel is a DP (dynamic positioning) vessel that does not require mooring or anchor lines, so the only apparatus to install is a conduit (30) that can be picked up by the vessel to extend between a stationary pipe end (24) that lies at the sea floor and the vessel. The conduit includes primarily a flexible hose (70) that extends in a sine wave with two loops (80, 82). The conduit includes a rigid reinforced hose section (34) that is pivotally connected to the sea floor. A chain (114) can be provided with a portion of the chain lying on the sea floor, to help the disconnected hose coupling (42D) remain at a stable position above the sea floor.

1 Claim, 5 Drawing Sheets

U.S. PATENT DOCUMENTS 3,883,912 A * 5/1975 Pedersen ..... 441/5
4,023,517 A * 5/1977 Ryan ..... 114/230.13
4,096,705 A * 6/1978 Lamy ..... 405/170
4,182,584 A * 1/1980 Panicker et al. ..... 405/224.3
4,279,543 A * 7/1981 Remery ..... 405/224.3
4,305,341 A * 12/1981 Stafford ..... 114/230.12
4,326,312 A * 4/1982 Tang ..... 441/5
4,375,835 A * 3/1983 Archer ..... 166/339
4,429,655 A * 2/1984 Tang ..... 114/230.13
4,459,065 A * 7/1984 Morton ..... 405/169
4,509,448 A * 4/1985 Pease et al. ..... 114/293
4,570,716 A * 2/1986 Genini et al. ..... 166/346
RE32,119 E * 4/1986 Abbott et al. ..... 405/227
4,637,335 A * 1/1987 Pollack ..... 114/230.12
4,650,431 A * 3/1987 Kentosh ..... 441/5
4,690,181 A * 9/1987 Carrio ..... 141/388
RE32,578 E * 1/1988 Poldervaart et al. ..... 441/5
4,727,819 A * 3/1988 Pollack ..... 114/230.12
4,730,677 A * 3/1988 Pearce et al. ..... 166/345
4,802,431 A * 2/1989 Pollack ..... 114/230.13
4,906,137 A * 3/1990 Maloberti et al. ..... 405/224.3
4,972,907 A * 11/1990 Sellars, Jr. ..... 166/353
5,041,038 A 8/1991 Poldervaart et al.
5,162,005 A * 11/1992 Poldervaart ..... 441/3
5,190,107 A * 3/1993 Langner et al. ..... 166/355
5,275,510 A 1/1994 de Baan et al.
5,288,253 A * 2/1994 Urdshals et al. ..... 441/5
5,305,703 A * 4/1994 Korsgaard ..... 441/4
5,341,884 A * 8/1994 Silva ..... 166/347
5,553,976 A * 9/1996 Korsgaard ..... 405/195.1
5,582,252 A * 12/1996 Richmond et al. ..... 166/352
5,615,977 A * 4/1997 Moses et al. ..... 405/195.1
5,683,204 A * 11/1997 Lawther ..... 405/171
5,794,700 A * 8/1998 Pollack ..... 166/339
5,823,131 A * 10/1998 Boatman et al. ..... 114/230.12
5,941,746 A * 8/1999 Isnard et al. ..... 441/4
5,944,448 A * 8/1999 Williams ..... 405/169
6,027,286 A * 2/2000 Pollack ..... 405/195.1
6,062,769 A * 5/2000 Cunningham ..... 405/195.1
6,082,283 A 7/2000 Parker
6,082,391 A * 7/2000 Thiebaud et al. ..... 137/236.1
6,182,763 B1 * 2/2001 Ingebrigtsen et al. ..... 166/366
6,321,844 B1 * 11/2001 Thiebaud et al. ..... 166/345
6,364,022 B1 * 4/2002 Kodaissi et al. ..... 166/367
6,834,724 B2 * 12/2004 Headworth ..... 166/384
6,854,930 B2 * 2/2005 Pionetti ..... 405/172
6,857,822 B2 * 2/2005 Hooper et al. ..... 405/224.4
7,172,479 B2 * 2/2007 Poldervaart et al. ..... 441/5
7,416,025 B2 * 8/2008 Bhat et al. ..... 166/355
2004/0238176 A1 * 12/2004 Appleford et al. ..... 166/353
2005/0042035 A1 * 2/2005 de Baan ..... 405/169
2005/0063788 A1 * 3/2005 Clausen ..... 405/224.2

FOREIGN PATENT DOCUMENTS

EP 0820927 A3 10/1998
FR 2656274 A1 12/1989
GB 2 269 351 A 2/1994
GB 2330157 A 4/1999

* cited by examiner

SUBMERGED LOADING SYSTEM

CROSS-REFERENCE

Applicant claims priority from U.S. Provisional Patent Application Ser. No. 60/760,069 filed Jan. 19, 2006.

BACKGROUND OF THE INVENTION

Intermittent offshore transfer systems are used to transfer fluids, especially hydrocarbons, between a vessel that repeatedly sails to and away from the system, and a pipeline that has a stationary pipe end lying at the sea floor. In one example, a transfer system is used in the production of hydrocarbons from an undersea reservoir, to transfer hydrocarbons passing from the reservoir along the pipeline up to the sea floor, up to the vessel. The vessel sails away to take the hydrocarbons to a distant location, offloads the hydrocarbons, and then returns for more. In this example, the undersea reservoir is small enough that it is not economical to set up a large production system, or this system has been set up as an early production system to produce hydrocarbons until a larger system is installed. In another example, a transfer system is used in the offloading of a vessel that has tanks that store hydrocarbons, to transfer the hydrocarbons to a pipeline that extends to an onshore refinery or to an onshore hydrocarbon gas distribution system. In either example, prior art transfer systems have included a fixed or anchored body to which the vessel is moored and to which the vessel is connected by a conduit, or the transfer system includes anchor chains and a conduit that both can be picked up by the vessel. A transfer system that minimized the setup procedure and the time required to set up a vessel so fluid transfer can begin, would be of value.

A deep water hydrocarbon loading system, described in U.S. Pat. No. 5,041,038, minimizes the setup procedure and time required, by providing a single pickup member that is attached to a group of conduits and a group of chains, so only one heavy member must be picked up and attached to the ship. All chains and conduits still must be initially installed in the sea, and each must be connected to the vessel. This results in a considerable cost to initially install the system, and the setup procedure for an arriving vessel is still complicated and time consuming.

SUMMARY OF THE INVENTION

In accordance with one embodiment of the invention, an intermittent offshore transfer system is provided that transfers fluid between a vessel and a pipeline that has a stationary pipe end at the sea floor, wherein the vessel repeatedly sails away and returns, which minimizes the cost of initial installation of the system and that minimizes the complexity and time consumed in connecting and disconnecting the vessel. The only part that must be picked up and connected to by the arriving vessel, is the upper end(s) of one or more conduits that extend to the sea floor. Anchor chains or weight compensating back chains are not used, so they do not have to be initially installed, do not have to picked up, and do not have to be connected to the vessel.

The conduit includes a flexible hose that extends along a majority of the conduit length. The hose extends in an approximately sine wave, with two loops. The loops include an upwardly open first loop at the bottom of a hose portion that extends at a downward incline from the vessel, and a downwardly open second loop that lies at the top of a hose portion that extends at an upward incline from the sea floor. Buoys are attached at spaced locations to the second loop. A weight or a plurality of spaced weights are attached to the top of the upper portion of the conduit. The weight(s) prevent a hose coupling at the upper end of the hose from moving along the sea bed and becoming damaged as a result of currents, heavy seas and/or storms. In one system, a buoy supports the hose coupling above the sea floor and a chain or line with clump weights supported by the buoy lies partially on the sea bed.

In a preferred system, the conduit lower end includes a rigid reinforced hose section having a length of a plurality of meters, that connects to the stationary pipeline end and that extends a plurality of meters above the sea floor. The rigid hose section is preferably connected to the stationary pipeline end in a pivot pipe connection that allows the rigid hose section to pivot about two perpendicular axes. This reduces changes in hose bending as the DP vessel moves with waves and changes in winds.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
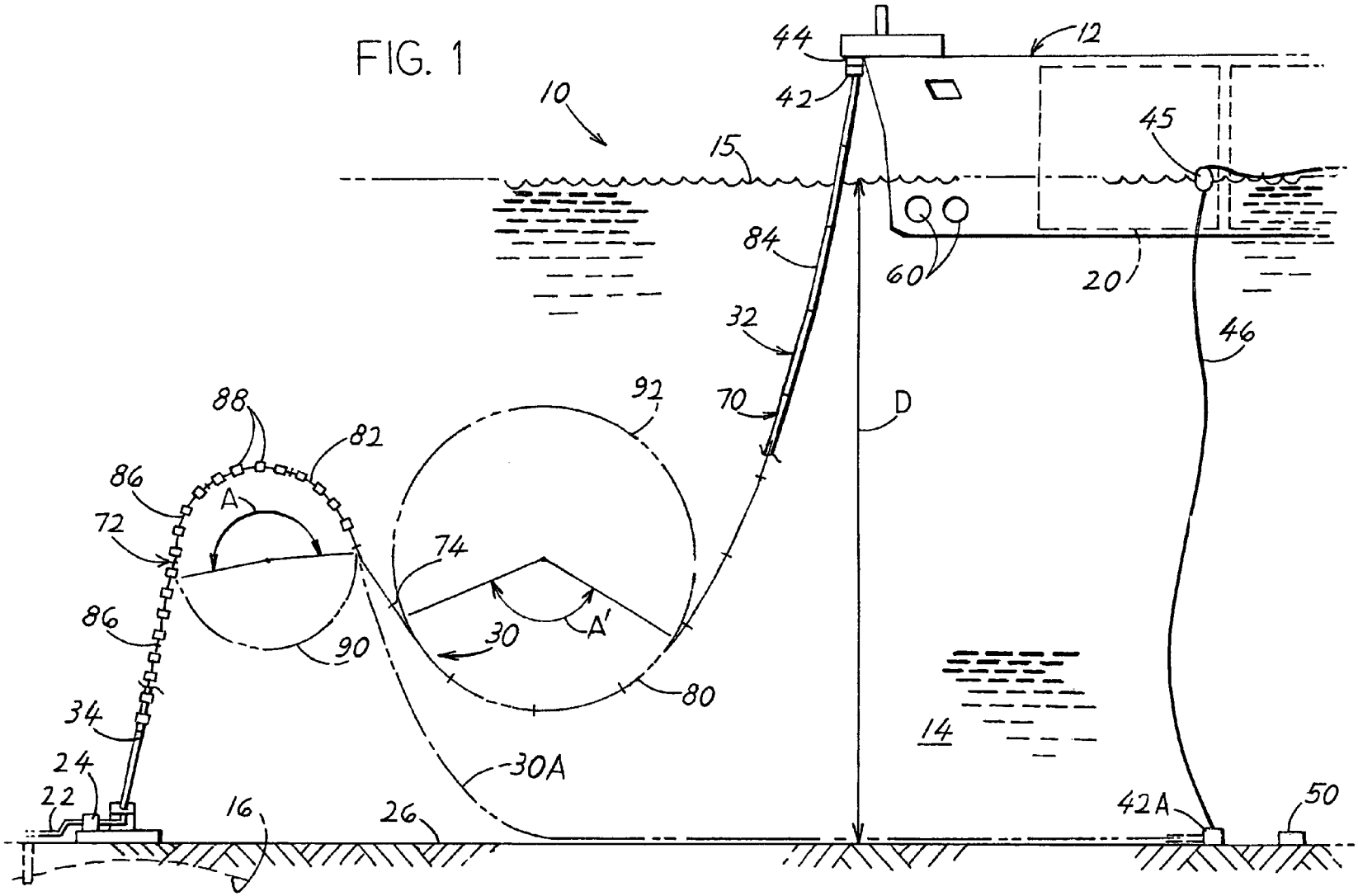
FIG. 1 is a side elevation view of a loading system of one embodiment of the invention, with the conduit connected to the vessel above the waterline.

FIG. 1 shows a loading system 10 of one embodiment of the invention, that includes a DP (dynamic positioning) vessel 12 that lies at a location 14 in a sea of a depth D, and that produces hydrocarbons from an undersea reservoir 16 and stores them in tanks 20 in the vessel. When the tanks are full, the vessel sails away to a distant location where the hydrocarbons are unloaded (loaded to another pipe), and then the vessel sails back to the location 14. The hydrocarbons flow from the reservoir through a pipeline 22 that has a stationary pipe end 24 that lies substantially (within 5 meters) at the sea floor 26, and though a conduit 30 that connects to the vessel at the bow or middle of the vessel. The conduit includes a flexible hose 32 and a rigid reinforced hose 34. When not connected to the vessel, the conduit lies in the position 30A with a hose coupling 42A lying on the sea floor. When hydrocarbons are to transferred to the vessel, the hose coupling at 42 has been lifted and connected to a connector 44 on the vessel which can be above or below the sea surface.

After the tanks on the DP vessel are filled with produced hydrocarbons (which have been cleaned to remove most stones, sand, water, etc.), the vessel sails away to a distant location where the hydrocarbons are unloaded. The vessel then sails back to the location 14 (unless there are large storms in the area). Applicant notes that some oil fields operate best when the production of hydrocarbons is as steady as possible, but others operate just about as well if there are interruptions. When the vessel returns to the location 14, personnel on the vessel lift a small locating or marker buoy 44 and a pickup line 46. The personnel may connect the pickup line to a winch that lifts the upper end of the conduit at 42A to the vessel. The hose coupling 42 at the upper end of the conduit is connected to the connector 44 on the vessel and a valve (not shown) at the hose coupling 42 and another one on the vessel at the connector are opened. Signals are sent to a valve(s) (not shown) located at the hose connector near the stationary pipe end 24 to open it and allow hydrocarbons to flow up though the conduit 30 to the vessel.

The system as shown in FIG. 1 can be used for loading unprocessed hydrocarbons from a well via the stationary pipe and the flexible hose to the connected vessel which can produce and store hydrocarbons. The system of FIG. 1 can also be used for loading hydrocarbons that are processed and stored on shore or offshore, into a carrier (oil tanker, LNG or pressurized gas carrier). The system as shown in FIG. 1 also can be used for the transfer of hydrocarbons in a reverse direction; for example to load LNG (liquefied natural gas) from a DP (dynamic positioning) LNG carrier via a flexible LNG hose into a stationary cryogenic pipeline, or for example gas via a submerged disconnectable flexible gas hose into a stationary gas pipe line in which the gas is received from a connected DP LNG carrier which is provided with a regassification unit.

Applicant relies solely on the dynamic positioning propulsion equipment 60, a global positioning system on the vessel, and transducers 50 on the seabed, or sea floor, to keep the vessel at a primarily constant position. Large waves, currents and winds generally will move the vessel away from the quiescent position illustrated, by more than a vessel that is anchored by chains to the sea floor, but the vessel can move back to its original position. At times, a large storm will approach the location 14, and the vessel will disconnect from the conduit and either ride out the storm or sail to another area. The vessel receives constant weather reports for its area. The fact that the vessel does not have to pick up and let down upper portions of heavy anchor chains or make secure connections to them at a turret, or do the reverse before sailing away, greatly reduces the time and effort required to make and break a connection. The fact that heavy chains and anchors, or a floating body for mooring, do not have to be installed, reduces initial construction and installation costs. The quiescent position is centered on a center ring that lies about halfway between a point directly above the stationary pipe end 24 that connects to the bottom of the conduit and a furthest position so far away that the conduit would extend in a straight line to the vessel. Quiescent positions lie in a ring-shaped area on the sea surface that is halfway from said point above the pipe end to said center ring and three quarters of the way to said furthest position.

Figure 2:
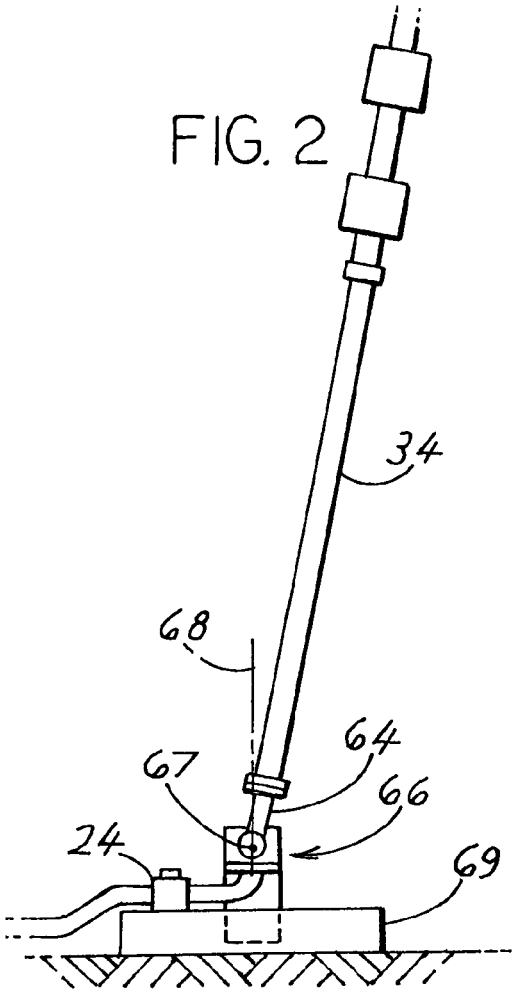
FIG. 2 is a side elevation view of a lower portion of the system of FIG. 1, showing a pivoting rigid reinforced hose section.
Figure 4:
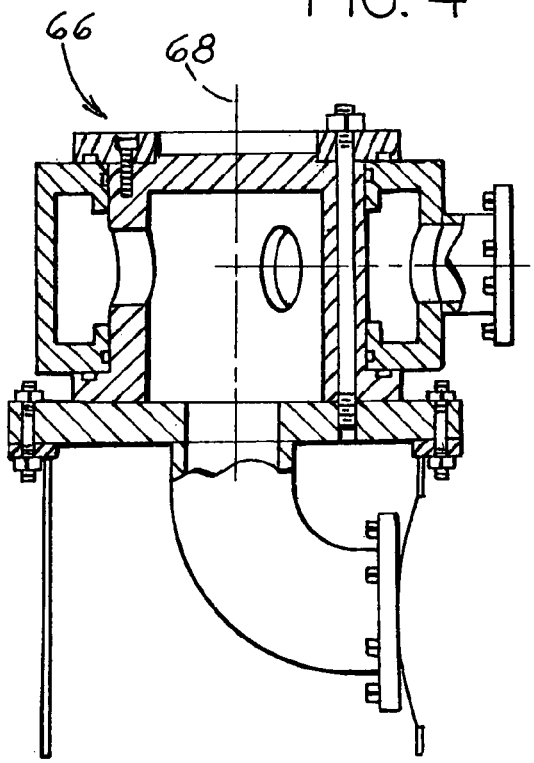
FIG. 4 is a sectional view of the fluid pivot joint of FIG. 3.
Figure 3:
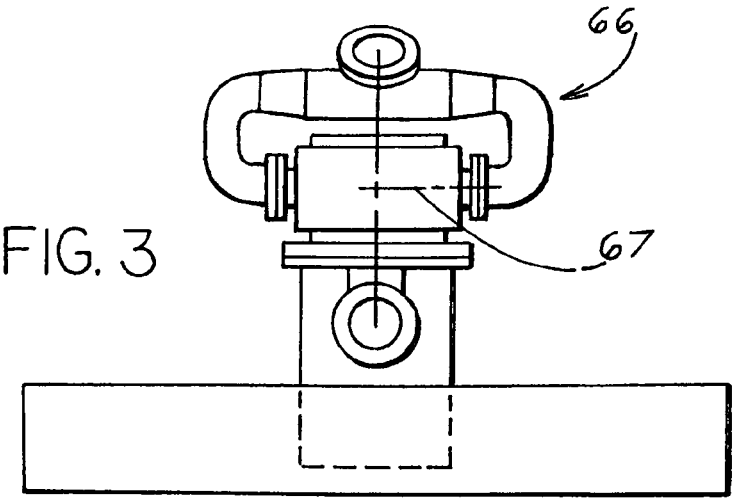
FIG. 3 is a front elevation view of the fluid pivot joint of FIG. 2.

As mentioned, the vessel generally will move further from the quiescent position than will an anchored vessel. Applicant constructs the conduit to allow such additional movements, especially for near shore and shallow waters so there is no danger that the conduit will drag on the seabed during loading even in extreme conditions. The conduit 30 includes the flexible hose 32 that extends along a majority of the conduit length, and preferably at least 80% and more preferably at least 90% of the conduit length. A rigid reinforced hose or pipe section 34 having a length preferably less than 10% of the entire conduit length, lies at the lower end of the flexible hose. As shown in FIG. 2, the rigid pipe section 34 (which may be a reinforced hose) has a lower end 64 connected though a fluid swivel 66 that lies on a sea floor base 68, to the stationary pipeline end 24. The fluid swivel allows the pipe section 34 to pivot about two perpendicular axes with respect to the stationary pipe end, the two axes being a horizontal axis 67 and a vertical axis 68. The pivoting rigid pipe section helps orient the lower end of the conduit toward the vessel as the vessel moves, to allow greater vessel movement away from the quiescent position without damaging the conduit and avoid the conduit touching the seabed.

FIG. 1 shows that the conduit 36 has a vessel-closest portion 70 and a sea-floor closest portion 72 that meet at a point 74. The two conduit portions have adjacent parts 80, 82 that each extends in primarily half of a sine wave and have opposite end parts 84, 86 of a progressively increasing radius of curvature. A full sine wave extends 360° and has two half sine waves that each extends 180°. A first 80 of the half sine wave opens upwardly, while the second 82 of the half sine waves opens downwardly. Each sine wave half extends by an angle A or A' of at least 100° and preferably at least 120° about a circle 90, 92 of a diameter of at least 10% of the sea depth, in the quiescent vessel position. Buoyancy cans 88 are attached to the conduit lower portion.

The particular system illustrated in FIGS. 1 and 2 is designed for use in a sea location of a depth D of 90 meters. The type of system illustrated is useful for sea locations of depths of no more than 500 meters, and preferably no more than 200 meters. In the system of FIG. 1 the rigid pipe section 34 has a length of 12 meters, and the flexible hose 30 has a length of 210 meters and a pipe diameter of 10 inches.

Figure 5:
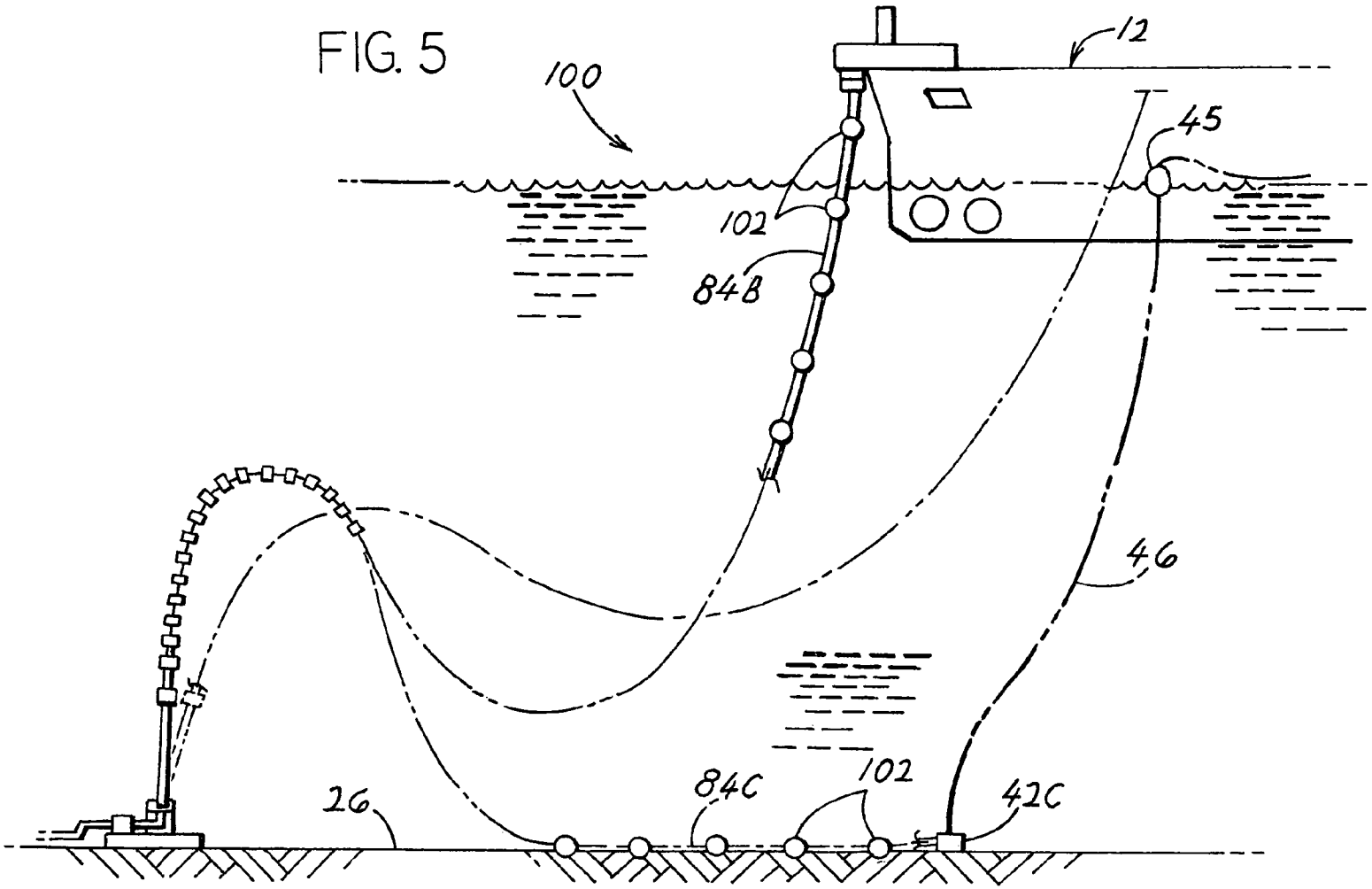
FIG. 5 is a side elevation view of a loading system of another embodiment of the invention.

When the hose coupling at 42A lies on the sea floor awaiting pickup by the vessel, the hose coupling and the upper part of the hose that lies on the seabed, may become damaged by movements along the sea floor. Such movements can be caused by large currents, heavy seas and/or storms, which is often when the coupling lies on the sea floor. FIG. 5 illustrates a system 100 which is similar to the system of FIG. 1, but with spaced-apart weights 102 attached to the conduit end part 84B that extends downward from the vessel. When the conduit end part at 84C lies on the sea floor 26, the weights press into the sea bed and greatly resist movement along the sea floor that would damage the hose coupling at 42C and/or the hose part lying on the seabed. It also is possible to use a single heavy weight instead of multiple distributed, or spaced, weights.

Figure 6:
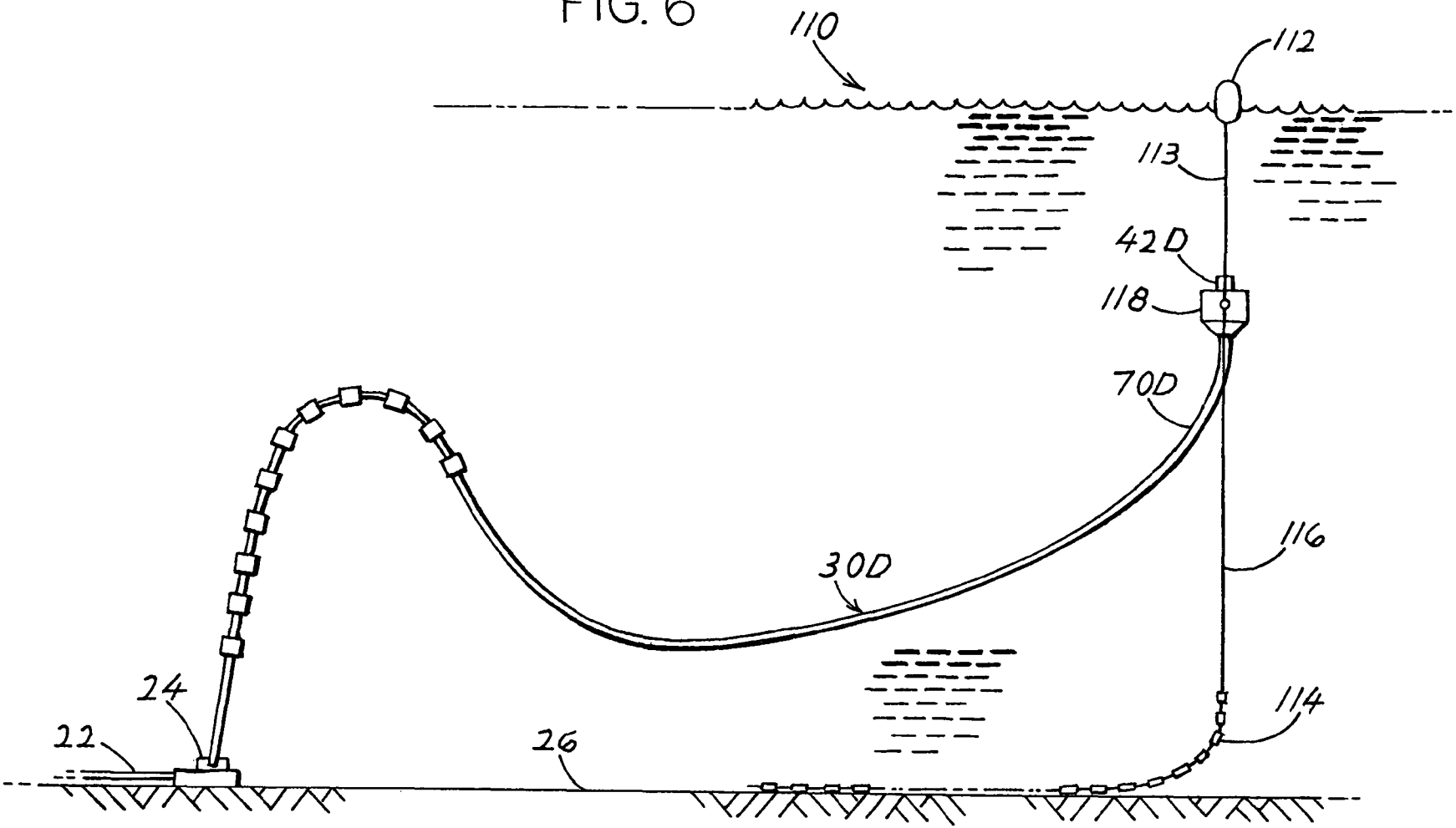
FIG. 6 Is a side elevation view of a loading system of another embodiment of the invention, with the conduit positioned for pickup by the vessel.

FIG. 6 illustrates a further modified system 110, positioned with the conduit 30D disconnected from the vessel and awaiting pickup, and with a pickup buoy 112 floating at the sea surface at the top of a pickup line 113. The pickup buoy helps to hold the conduit upper portion 70D above the sea floor. The upper end of the conduit, at the hose coupling 42D, lies above the sea floor, but below the bottom of the vessel. To stabilize the position and especially the height of the hose coupling 42D and the upper part of the hose, applicant hangs a weight in the form of a heavy chain 114 from the lower end of an auxiliary line 116 (that can be part of the pickup line 113) that hangs from a large buoy 118. A small length of the chain (less than 10 meters) is held above the sea floor. If the hose coupling 42D and auxiliary buoy 118 lift or drift, additional chain will be lifted off the sea floor and pull back the coupling. Instead of a chain, spaced weights can be hung from the auxiliary line.

Figure 7:
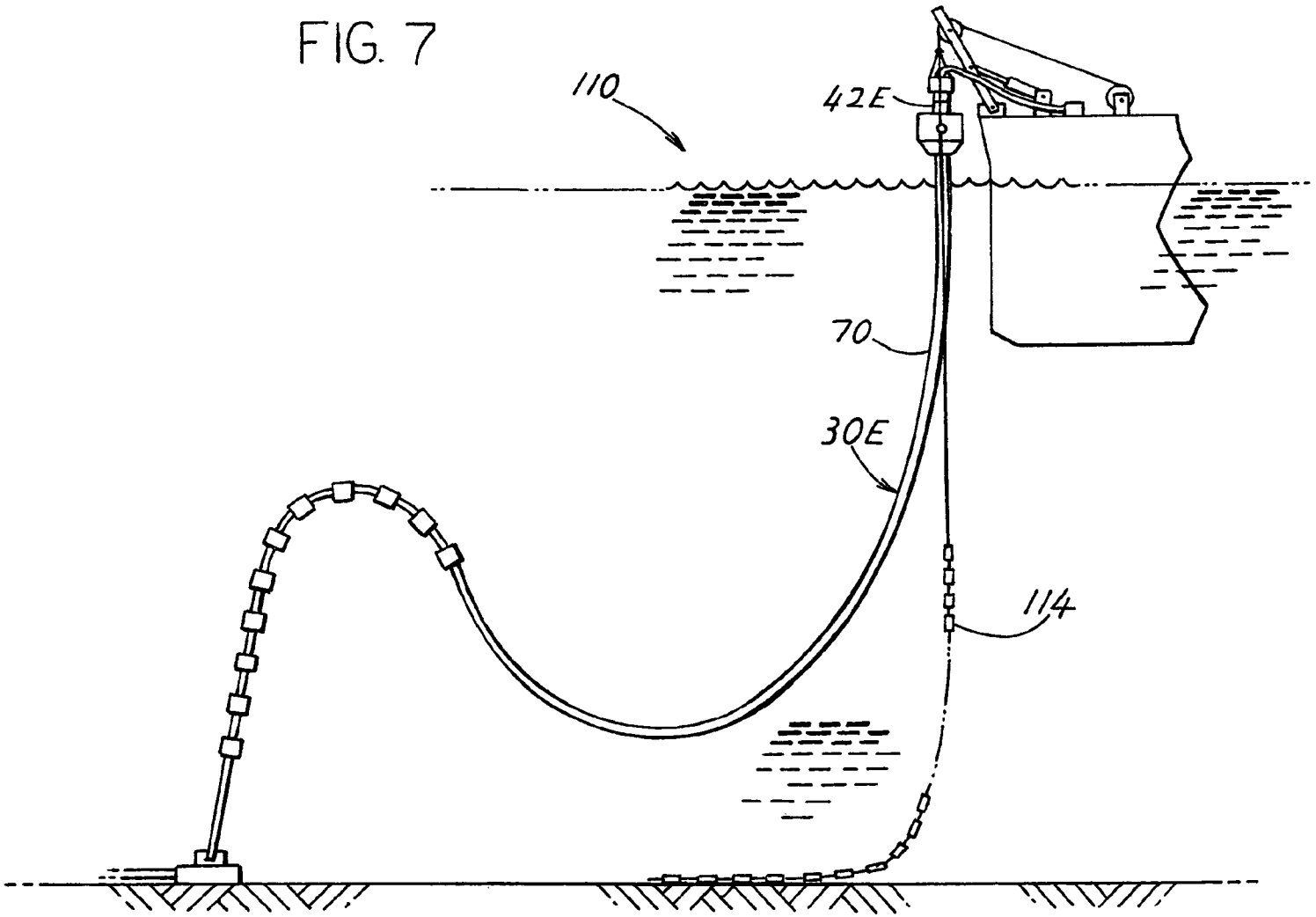
FIG. 7 is a side elevation view of the system of FIG. 5, with the vessel having lifted the conduit.

FIG. 7 shows the conduit 30E of system 110 after the conduit has been lifted so its hose coupling at 42E is connected to the vessel. Such lifting of the hose coupling and the vessel-closest portion 70 of the conduit results in a considerable length of the chain 114 being lifted off the sea floor. In the particular system of FIG. 7, at least 10 meters of chain remain on the sea floor. The chain 114 helps in resisting drift of the vessel from the quiescent position illustrated, because any drift requires more chain to be lifted above the sea floor.

Thus, the invention provides a submerged loading system for passing hydrocarbons between a stationary pipe end lying approximately at the sea floor and a vessel that floats at the sea surface. The vessel is a DP (dynamically moored) vessel and is free of anchor or mooring lines or chains that would moor it to another body or to the sea floor. As a result, the conduit that carries fluid between the stationary pipe end and the vessel is long and constructed to allow considerable drift of the vessel in shallow waters. The conduit extends in basically a sine wave, with a vessel-connected portion of the conduit forming a loop of a half sine wave with a loop open upper end, and merging with a sea floor-connected conduit portion having a loop of a half sine wave having a loop open lower end, with both loops having a large radius of curvature in the quiescent vessel position. The conduit also has a lower end that comprises a rigid reinforced hose section or rigid pipe section that is preferably pivotally mounted on a platform on the sea floor. Weights, such as in the form of a heavy chain are attached to the conduit upper portion, or hang from the lower end of a buoy-supported pickup line which supports the hose coupling end above the sea floor.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore hydrocarbon loading system for use in a sea location of a predetermined depth comprising a dynamic positioning vessel that floats at the sea surface and is free of a mooring connection to the sea floor through lines or chains, and a pipe with a stationary pipe end (24) lying approximately on the sea floor, the system including a conduit (30) that includes a flexible hose (70), with said conduit extending between said stationary pipe end and said vessel, wherein:

said conduit includes a fluid-carrying rigid pipe section (34) that extends a distance of a plurality of meters at an upward incline from said stationary pipe end and that connects to said flexible hose but with said rigid pipe section having a length no more than 10% of the said conduit length to carry fluid between them;

said rigid pipe section including a base fixed to the sea floor, and a pivot fluid swivel (66) through which fluid flows and that pivotally connects a lower end of said rigid pipe section to said stationary pipe end and that allows said rigid pipe section to pivot about two perpendicular axes (67, 68) on said base, said flexible hose extending in line with and primarily vertically upward along a plurality of meters above an upper end of said rigid pipe section, said flexible hose extending along a majority of the conduit length between said stationary pipe end and said vessel.

* * * * *